US008591274B2

(12) United States Patent
Haller et al.

(10) Patent No.: US 8,591,274 B2
(45) Date of Patent: Nov. 26, 2013

(54) INFLATABLE STAND UP PADDLEBOARD

(75) Inventors: Clay Haller, Concord, CA (US); Charles P. Hall, Bainbridge, WA (US)

(73) Assignee: Advanced Elemetns, Inc., Concord, CA (US)

( * ) Notice: Subject to any disclaimer, the term of this patent is extended or adjusted under 35 U.S.C. 154(b) by 177 days.

(21) Appl. No.: 13/305,624

(22) Filed: Nov. 28, 2011

(65) Prior Publication Data

US 2013/0137319 A1 May 30, 2013

(51) Int. Cl.
*B63B 1/00* (2006.01)

(52) U.S. Cl.
USPC ..... 441/66; 114/345

(58) Field of Classification Search
USPC ..... 114/345, 347, 354; 441/40, 65, 66, 74
See application file for complete search history.

(56) References Cited

U.S. PATENT DOCUMENTS

| | | | | |
|---|---|---|---|---|
| 3,414,919 | A * | 12/1968 | Gust | 441/74 |
| 6,036,560 | A * | 3/2000 | Pekar | 441/65 |
| 7,347,754 | B1 * | 3/2008 | Cheung | 441/65 |
| 2009/0049757 | A1 * | 2/2009 | Potter | 441/74 |

* cited by examiner

*Primary Examiner* — Lars A Olson
(74) *Attorney, Agent, or Firm* — Bay Area Technology Law Group PC

(57) ABSTRACT

An inflatable stand up paddleboard having a top surface for supporting a user and a bottom surface for residing on water. The inflatable stand up paddleboard being characterized as having a front end and back end and a longitudinal axis passing between the front and back ends. The inflatable stand up paddleboard is configured to receive at least one beam for stiffening the inflatable stand up paddleboard positioned substantially parallel to the longitudinal axis.

7 Claims, 3 Drawing Sheets

INFLATABLE STAND UP PADDLEBOARD

TECHNICAL FIELD

The present invention is directed to an inflatable stand up paddleboard having a stiffening beam for improving its characteristics by reducing board flexure and thus providing a user with a superior riding experience.

BACKGROUND OF THE INVENTION

Stand up paddleboarding is an aquatic experience that is rapidly growing in popularity. Stand up paddleboarding involves employing an oversized surfboard in combination with a paddle for propulsion.

The sport of stand up paddleboarding was created to provide an aquatic activity when surf was down and the ocean surface flat. When combined with paddles, the surfboard could be used without significant wave action. Even when waves increased, those employing stand up maneuvers on paddleboards found that they could execute more interesting twists and turns by using a paddle to steer. Windsurfers became early adopters of stand up paddleboards as they were already comfortable with standing on a board and found stand up paddleboarding an excellent aquatic activity particularly when wind conditions did not provide sufficient propulsion for sailboarding.

There are several types of stand up paddleboards currently available in the marketplace. Rigid stand up paddleboards are made of foam or fiberglass, much like surfboards. Because these products are generally larger than surfboards, rigid boards can be difficult to transport. Placing them atop a moving vehicle, for example, can prove challenging as their surface area can catch wind and destabilize the vehicle. In extreme conditions or when the board is not sufficiently secured to the vehicle, it can fly from the vehicle's rooftop or cargo area and not only be damaged or destroyed in the process but also cause a significant traffic hazard.

Inflatable stand up paddleboards thus represent an excellent alternative to rigid products. Inflatable stand up paddleboards are made of drop stitched material allowing them to be inflated to very high pressures, generally from 12 to 15 psi.

The drop stitch manufacturing process begins by joining two pieces of 500 denier polyester woven support fabric having thousands of fine polyester thread lengths. This base material is made in strips from 5 to 10 feet in width and up to 400 needleheads may be used in the setup. Each needle sews a continuous, evenly spaced thread, back and forth between the two pieces of woven fabric locking them together into an impressively strong unit. Drop stitch sewing machines are complex. For example, when a change is to be made in the spacing distance between the two pieces of woven fabric, it can take over 20 days to remove and replace the required needles.

After stitching, an airtight coating is applied to the outer surface of both sides of the polyester woven support fabric and a sidewall material is then glued to it followed by a wide seam tape glued over each lap seam to create an airtight final product.

Most currently available inflatable stand up paddleboards are similarly constructed, the only difference being the shape of the board and the accessories such as D-rings and foam padding applied thereto. Even though the drop stitch material facilitates high pressures, all currently available boards are plagued by unwanted flex. The heavier the paddler, the more flex. This degrades the user experience forcing enthusiasts to turn towards rigid foam or fiberglass products despite their inherent limitations.

It is thus an object of the present invention to provide a high pressure inflatable stand up paddleboard having the convenience of an inflatable product while overcoming its limitations.

These and further objects will be more readily appreciated by considering the following disclosure and appended claims.

SUMMARY OF THE INVENTION

An inflatable stand up paddleboard having a top surface for supporting a user and a bottom surface for residing on water. The inflatable stand up paddleboard being characterized as having a front end and back end and a longitudinal axis passing between the front and back ends. The inflatable stand up paddleboard is configured to receive at least one beam for stiffening the inflatable stand up paddleboard positioned substantially parallel to the longitudinal axis.

DETAILED DESCRIPTION OF THE INVENTION

Figure 1A:
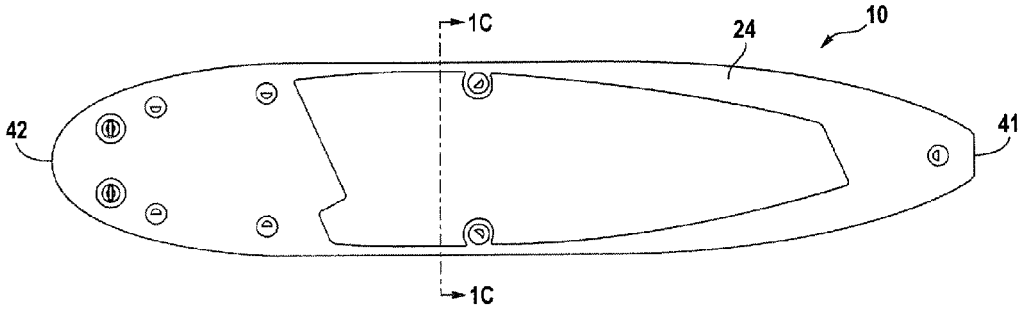
FIG. 1A is a top view of an inflatable stand up paddleboard of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Figure 1B:
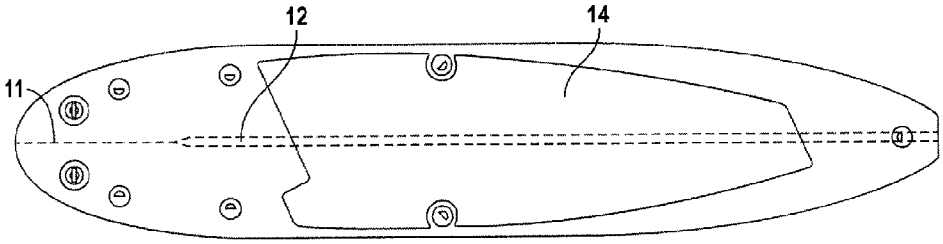
FIG. 1B is a bottom plan view of the inflatable stand up paddleboard of FIG. 1A.
Figure 1C:
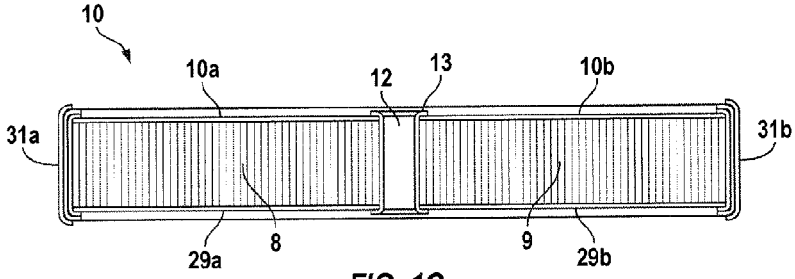
FIG. 1C is a cross sectional view of the inflatable stand up paddleboard of FIG. 1A taken along line A-A.

As noted, the present invention involves an inflatable stand up paddleboard 10 generally composed of sidewalls created by joining two pieces of 500 denier polyester woven support fabric 8 and 9 (FIG. 1C). Sidewall material 31*a* and 31*b* (FIG. 1C) are glued to sidewall material 29*a* and 29*b* creating an extremely strong construction that can be inflated to pressures up to 15 pounds per square inch. Nevertheless, inflatable stand up paddleboards tend to be less rigid than their foam and fiberglass counterparts which detracts from the advantages that inflatable stand up paddleboards generally offer.

In going back to FIGS. 1A, 1B and 1C, inflatable stand up paddleboard 10 is characterized as having top surface 24 and bottom surface 14 whose construction is shown in FIG. 1C by taking the cross section of paddleboard 10 along line A-A.

There are several embodiments of the present invention all directed toward the placement of at least one beam for stiffening paddleboard 10, beam 16 positioned parallel to longitudinal axis 11 (FIG. 1B), the details of which will be more readily appreciated in the discussion which follows.

Figure 2:
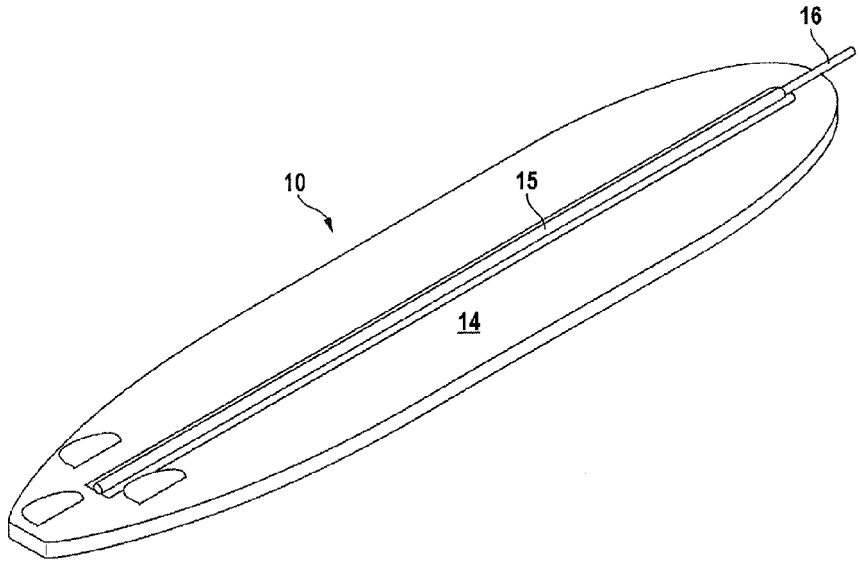
FIGS. 2 and 3 are bottom and top perspective views of the inflatable stand up paddleboard of the present invention illustrating a first embodiment thereof.
Figure 3:
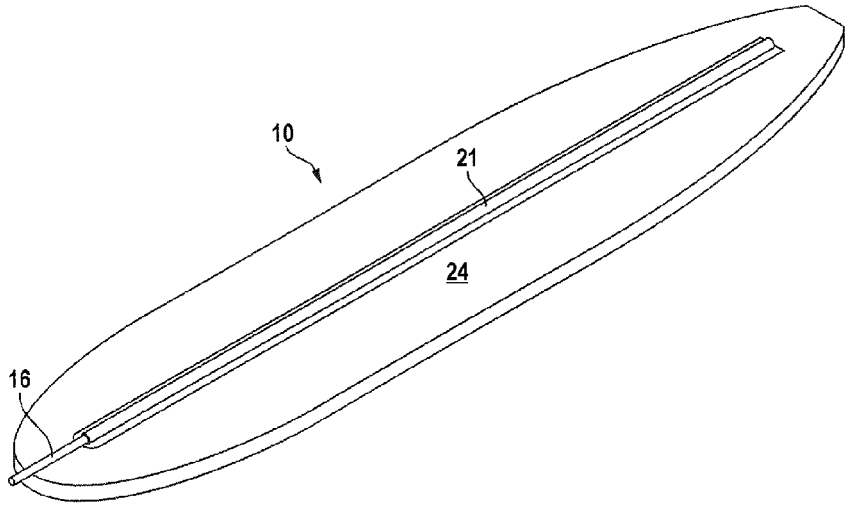

A first such embodiment is shown in FIGS. 2 and 3. Inflatable stand up paddleboard 10 is shown in FIG. 2 with its bottom surface 14 facing upwardly. Sleeve 15 is glued or otherwise appended to surface 14, said sleeve being composed of flexible or semi-rigid material sized to receive beam 16 along longitudinal axis 11. It is noted that beam 16 need not traverse the entire length of inflatable stand up paddleboard 10 but is of sufficient length to significantly enhance the rigidity of inflatable stand up paddleboard 10 along longitudinal axis 11.

As noted in reference to FIG. 3, sleeve 15 could alternatively be situated as sleeve 21 on top surface 24 of inflatable stand up paddleboard 10 with similar rigidifying results. However, when sleeve 15 is employed in its FIG. 2 embodiment, sleeve 15 can also act as a stabilizing fin to enhance tracking performance.

Figure 4:
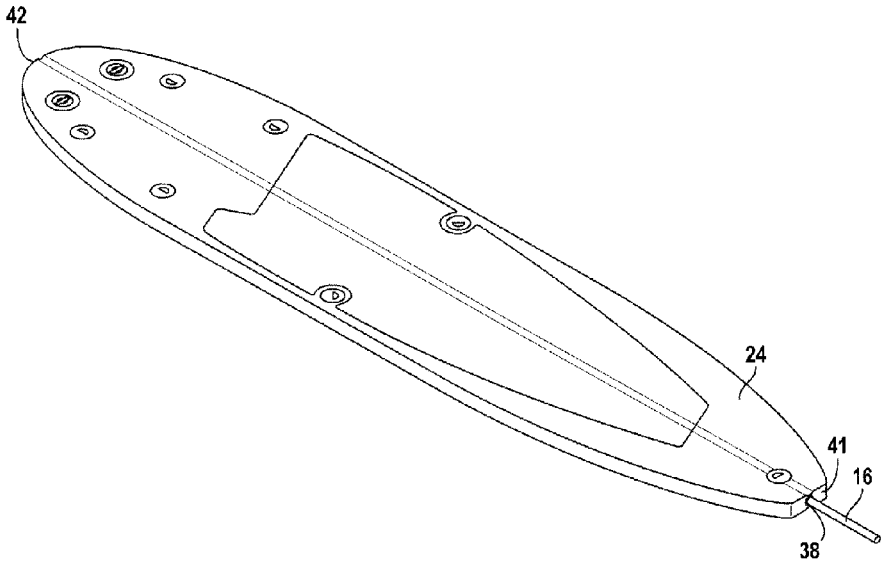
FIG. 4 is a top perspective view of the inflatable stand up paddleboard of the present invention illustrating a second embodiment thereof.

As an alternative for locating beam 16 on the top or bottom surface of inflatable stand up paddleboard 10, channel 12 can be configured within it by splitting inflatable stand up paddleboard 10 into two parts 10*a* and 10*b* and reconnecting these parts through the use of joining strip 13 which is glued on the top and bottom of inflatable stand up paddleboard sections 10*a* and 10*b* as shown in FIG. 1C. A gap is thus created into which beam 16 can be inserted. This is further shown in FIG. 4 noting opening 38 within front end 41.

Figure 5:
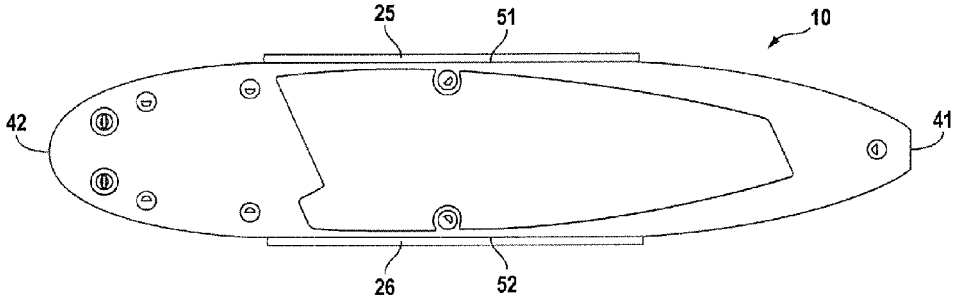
FIG. 5 is a top plan view of the present inflatable stand up paddleboard illustrating its third embodiment.

As yet another embodiment of the present invention, reference is made to FIG. 5 showing paddleboard 10. In this embodiment, sleeves 25 and 26 are secured to the outer edges 51 and 52, respectively, to enable beams to be inserted therein. As a consequence, a pair of stiffening beams, each being substantially adjacent edges 51 and 52 which extend fore and aft to encompass the anticipated position of a user and are positioned substantially parallel to longitudinal axis 11. As a preferred embodiment, it is noted that sleeves 25 and 26 can be slightly larger in diameter than the cross section of the beams to be inserted therein with a snug fit created when inflatable stand up paddleboard 10 is inflated around sleeves 25 and 26. These sleeves can ideally be closed at their front ends and open at their back ends for selectively receiving beams.

It is noted that beam 16 can be made of any suitable material such as aluminum or fiberglass and can be constructed in two parts to enable beam 16 to be broken down to enable it to be more easily stored or transported by backpack etc.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. In an inflatable stand up paddleboard having a top surface for supporting a user and a bottom surface for residing on water, a front end and a back end and a longitudinal axis passing between said front and back ends, the improvement comprising a channel configured between said top and bottom surfaces and a beam sized to slidably reside within said channel, wherein said paddleboard comprises a left side and a right side, said left side and right side joined to create said channel, and wherein said left side and right side are joined by gluing a joining strip along said top and bottom surfaces creating said channel.

2. In an inflatable stand up paddleboard having a top surface for supporting a user and a bottom surface for residing on water, a front end and a back end and a longitudinal axis passing between said front and back ends, the improvement comprising a sleeve positioned along said longitudinal axis and a beam sized to releasably reside within said sleeve, wherein said sleeve is affixed to said top surface.

3. The inflatable stand up paddleboard of claim 2 wherein said sleeve is affixed to said bottom surface.

4. In an inflatable stand up paddleboard having a top surface for supporting a user and a bottom surface for residing on water, a front end and a back end and a longitudinal axis passing between said front and back ends, a left side and a right side defining edges of said inflatable stand up paddleboard extending between said front and back ends, the improvement comprising a sleeve configured on said paddleboard on its left side and a sleeve configured on said paddleboard proximate on its right side, each sleeve being substantially parallel to said longitudinal axis and a pair of beams each sized to releasably reside within said sleeves.

5. An inflatable stand up paddleboard having a top surface for supporting a user and a bottom surface for residing on water, a front end and a back end and a longitudinal axis passing between said front and back ends, and at least one beam for stiffening said inflatable stand up paddleboard positioned parallel to said longitudinal axis, wherein said beam is appended to said top surface.

6. The inflatable stand up paddleboard of claim 5 wherein said beam is appended to said bottom surface.

7. The inflatable stand up paddleboard of claim 5 having a left side and a right side defining edges of said inflatable stand up paddleboard between said front and back ends, wherein a beam is positioned proximate each of said edges and oriented substantially parallel to said longitudinal axis.

* * * * *